United States Patent [19]

Panke

[11] 4,035,758

[45] July 12, 1977

[54] ADJUSTABLE VARIABLE RESISTANCE CONTROL SYSTEM

[75] Inventor: Alfred A. Panke, Frankfort, Ind.

[73] Assignee: P. R. Mallory & Co., Inc., Indianapolis, Ind.

[21] Appl. No.: 667,088

[22] Filed: Mar. 15, 1976

[51] Int. Cl.[2] ..... H01C 10/16

[52] U.S. Cl. ..... 338/132; 338/128

[58] Field of Search ..... 38/128–132, 38/134

[56] References Cited

U.S. PATENT DOCUMENTS 2,958,837 11/1960 Barden ..... 338/134

*Primary Examiner*—C. L. Albritton

*Attorney, Agent, or Firm*—Hoffmann, Meyer & Coles

[57] ABSTRACT

A first rotor is fixedly carried by a shaft and a second rotor is loosely carried by the shaft. A coupling means couples the second rotor to the shaft through an interference fit with the second rotor. The two rotors are then adjusted with respect to one another by rotating the shaft while holding the second rotor in place.

2 Claims, 2 Drawing Figures

ADJUSTABLE VARIABLE RESISTANCE CONTROL SYSTEM

This invention relates to variable resistance control systems and more particularly to such control system wherein one rotor of a variable resistance control needs to be adjusted with respect to a rotor of another variable resistance control.

Variable resistance control systems are widely used in appliances such as radios, televisions and stereos. In stereos, the control systems are used to regulate, among other things, the volume of the sound output of the speakers by regulating the resistance in the electrical circuit of the speakers. In such applications, one of the problems is that of insuring that when the output of one of the speakers is changed, the other(s) speaker is changed accordingly. To this end, it is imperative that the rotor, which carries the electrical contacts to bridge the resistance and collector paths, be predeterminatively set with respect to the other(s) rotors of the system.

Accordingly it is a feature of the present invention to provide a variable resistance control system that is especially useful in stereos. Another feature of the invention is the provision of such a system wherein a rotor of one control is adjustable with respect to another. Another feature of the invention is to provide such a control system wherein two rotors are carried on the same shaft one of the rotors being fixedly carried, the other being loosely carried but coupled to the shaft through an interference fit with the rotor. Still another feature of the invention is the provision of such a control system wherein the interference fit is provided by barb means fixedly carried by the rotor and engaging a face of the rotor. Yet still another feature of the invention is the provision of a method of adjusting one rotor with respect to the other. Another feature of the invention is the provision of such a method wherein one rotor is fixedly carried on a shaft, the other loosely carried but coupled to the shaft, the shaft being rotated while the loosely carried rotor is held in a fixed position.

These and other features of the invention will become apparent from the following description taken in conjunction with the accompanying drawing wherein.

Figure 1:
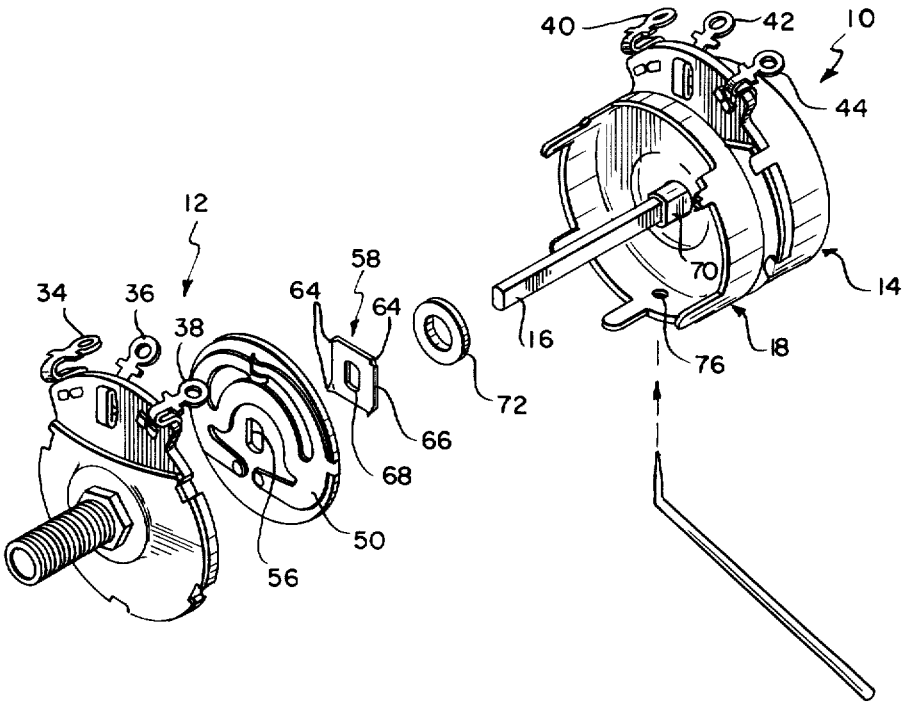
FIG. 1 is an exploded view of a control system.
Figure 2:
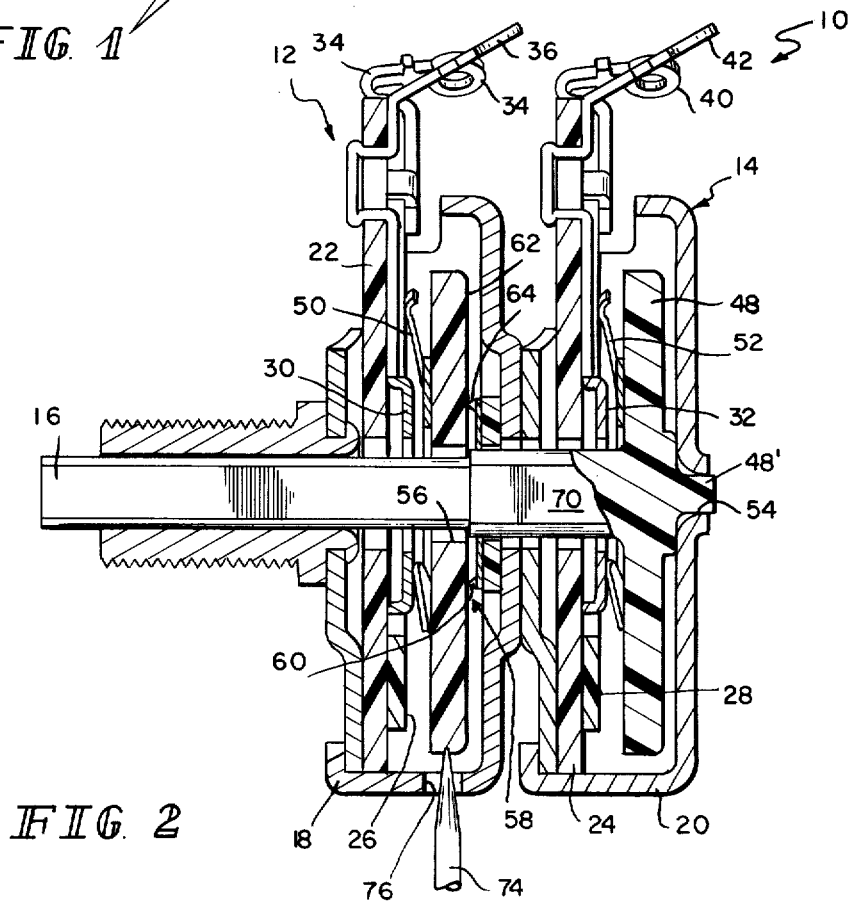
FIG. 2 is a section taken in elevation of the control system.

Referring to the drawings, control system 10, in general, includes two variable resistance control units 12 and 14 each carried by a shaft 16. In general, each variable resistor includes a cup shaped housing member 18 and 20 closed by a terminal board 22 and 24. Resistance paths 26 and 28 and collector paths 30 and 32 are carried by the terminal boards and are electrically connected to electrical terminals 34, 36, 38, 40, 42, and 44. Rotors 46 and 48 are carried by shaft 16 and carry electrical contact arms 50 and 52 which engage the resistance paths and the collector paths to electrically bridge the same as the rotors are rotated.

Rotor 48 is fixedly carried on shaft 16 and includes a hub portion 48' which is rotatably journalled in aperture 54.

Rotor 46 is loosely carried on shaft 16, the aperture 56 of the rotor being slightly larger than the size of shaft 16. Thus there is some "play" in the rotation of the rotor with respect to the shaft such that the shaft may be rotated in slight amount independent of the rotor. As will be hereinafter described, however, coupling means 58 couples the rotor to the shaft for normal control operation but permits the rotor to be adjusted with respect to rotor 48. Coupling means 58 includes at least one barb or projection 64 which engages a face 62 of rotor 46 and which is fixedly coupled to shaft 16. In the embodiment shown, a plurality of barbs are carried on plate 66. Plate 66 is fixedly carried on shaft 16 through aperture 68 which mates collar 70 to provide a tight fit therewith. A spacer 72 is provided to assure a good interference fit between the barbs and face 62 of the rotor.

With the described arrangement of rotor 46, rotor 48 can be adjusted with respect to rotor 46 by holding rotor 46 in place while turning shaft 16. In the illustrative embodiment, rotor 46 is held by inserting a suitable tool such as a stylus 74 through aperture 76 to engage the rotor and hold it. Holding the rotor while rotating the shaft permits the barbs to slip over surface 62 while rotor 48 is being rotated to be adjusted with respect to rotor 46. After the rotors have been adjusted, the interference fit between barbs 64 and face 62 will insure normal operation of the rotor when shaft 16 is turned.

With the rotors being adjusted with respect to each other, the relative position of contact arms 50 and 52 are set according to predetermined positions so as to maintain a predetermined relationship of the resistance of one control unit with respect to the other.

The operation of the variable resistance control units are the same as that known in the art, once the rotors have been adjusted. Rotation of shaft 16 causes rotation of rotors 46 and 48 to vary the resistance of the units as the contact arms 50 and 52 pass over their respective resistance and collector paths.

What is claimed is:

1. In a control system wherein first and second rotors are carried by a shaft and wherein electrical contact means are carried by said first and second rotors electrically bridging first and second resistance and collector paths, the improvement characterized by a system permitting adjustment of said first and second rotors with respect to each other comprising:

a. said first rotor fixedly carried by said shaft, b. said second rotor loosely carried by said shaft, and c. barb means coupled to said shaft and engaging a face of said second rotor and providing an interference fit therewith.

2. In a control means according to claim 1 wherein said barb means includes a plate fixedly carried by said shaft and at least one barb carried by said plate engaging said face.

* * * * *